US009177719B2

(12) United States Patent
Yamaguchi et al.

(10) Patent No.: US 9,177,719 B2
(45) Date of Patent: Nov. 3, 2015

(54) EDGEWISE WOUND COIL MANUFACTURING DEVICE

(75) Inventors: Kazuyuki Yamaguchi, Kariya (JP); Takuya Hasegawa, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 399 days.

(21) Appl. No.: 13/696,447

(22) PCT Filed: Jun. 6, 2011

(86) PCT No.: PCT/JP2011/062945

§ 371 (c)(1),
(2), (4) Date: Nov. 6, 2012

(87) PCT Pub. No.: WO2011/158683

PCT Pub. Date: Dec. 22, 2011

(65) Prior Publication Data

US 2013/0056110 A1 Mar. 7, 2013

(30) Foreign Application Priority Data

Jun. 16, 2010 (JP) ..... 2010-137580

(51) Int. Cl.
*H01F 41/06* (2006.01)

(52) U.S. Cl.
CPC ..... *H01F 41/0612* (2013.01); *H01F 41/0633* (2013.01)

(58) Field of Classification Search
CPC . H01F 41/0612; H01F 41/0633; H01F 41/02; H01F 41/0206; H01F 41/022; H01F 41/0226; H01F 41/04; H01F 41/065; B21F 3/00; B21F 3/02; B21F 3/04; H02K 3/24
See application file for complete search history.

(56) References Cited

U.S. PATENT DOCUMENTS 7,314,195 B2 * 1/2008 Takeda et al. ..... 242/445.1
2001/0005934 A1 7/2001 Nakamura et al.
2007/0266552 A1 * 11/2007 Roth et al. ..... 29/605

FOREIGN PATENT DOCUMENTS

DE 19905747 A1 9/1999
JP 58-173818 A 10/1983

(Continued)

OTHER PUBLICATIONS

International Search Report for PCT/JP2011/062945 dated Sep. 6, 2011.

(Continued)

*Primary Examiner* — Debra Sullivan
(74) *Attorney, Agent, or Firm* — Sughrue Mion, PLLC

(57) ABSTRACT

Disclosed is an edgewise wound coil manufacturing device for manufacturing an edgewise wound coil. The edgewise wound coil manufacturing device is provided with: a plurality of corners; a core having a recess formed between each pair of adjacent corners, and around which a flat wire is wrapped; a rotating part that forces the core to rotate around the central axis of the core; guide parts that hold the flat wire therebetween in the thickness direction, while guiding the flat wire in such a manner that the flat wire wraps around the core; a first moving part that forces at least one of the guide parts and the core to move in the approaching/receding direction of the other; and a controller that adjusts the amount that the first moving part moves such that the edgewise wound coil achieves the desired shape.

5 Claims, 5 Drawing Sheets

(56) References Cited

FOREIGN PATENT DOCUMENTS

| | | | |
|---|---|---|---|
| JP | 59-139615 | A | 8/1984 |
| JP | 11-97273 | A | 4/1999 |
| JP | 2006-269715 | A | 10/2006 |

OTHER PUBLICATIONS

Translation of the International Preliminary Report on Patentability for corresponding International Patent Application No. PCT/JP2011/062945 issued on Jan. 15, 2013.

* cited by examiner

EDGEWISE WOUND COIL MANUFACTURING DEVICE

CROSS REFERENCE TO RELATED APPLICATIONS

This application is a National Stage of International Application No. PCT/JP2011/062945 filed Jun. 6, 2011, claiming priority based on Japanese Patent Application No. 2010-137580 filed Jun. 16, 2010, the contents of all of which are incorporated herein by reference in their entirety.

FIELD OF THE INVENTION

The present invention relates to an edgewise wound coil manufacturing device for manufacturing an edgewise wound coil.

BACKGROUND OF THE INVENTION

An edgewise wound coil formed by winding a flat wire is manufactured, for example, using a magnetic field coil manufacturing device disclosed in Patent Document 1. The manufacturing device disclosed in Patent Document 1 includes a core around which a flat wire is wound, a first driving part for rotating the core, a guide for guiding the flat wire when it is wound, a second driving part for pressing the guide against the core, a third driving part for moving the core or the guide in an axial direction of the core, and a base for movably supporting the first, second and third driving parts. According to this manufacturing device, the first driving part rotates the core, and the second driving part brings the guide into contact with the core. The flat wire is pressed against a surface of the core by the guide and the flat wire is wound around the core. Simultaneously, the third driving part moves the core or the guide in the axial direction of the core. Therefore, the flat wire is pressed against the surface of the core and in this state, the flat wire is helically wound. As a result, the edgewise wound coil formed by winding the flat wire in a cylindrical shape is manufactured.

An edgewise wound coil formed by winding the flat wire in a polygonal shape is also manufactured. To manufacture such an edgewise wound coil, a manufacturing method of a polygonal coil described in Patent Document 2 is employed, for example. The manufacturing method of Patent Document 2 uses a polygonal core, which has two opposed surfaces with recesses, and a pressure roller arranged to face the recesses of the core. The pressure roller is pressed against the core by a spring or a hydraulic system.

When the coil is formed, a thin conductor (flat wire) is wound around the core while being pressed by the pressure roller against the core. At this time, portions of the thin conductor that corresponds to the recesses are depressed toward the core, and depressed parts of the coil are formed. When the core is pulled out of the coil, an edgewise wound coil formed by winding the thin conductor in a polygonal shape is manufactured. In the manufacturing method of Patent Document 2, since the depressed parts of the coil cancel or compensate for swells of the coil, which are generated after the core is pulled out, a coil is manufactured in which its straight part between angle portions of the coil extends in a straight manner.

PRIOR ART DOCUMENT

Patent Document

Patent Document 1: Japanese Laid-Open Patent Publication No. 2006-269715

Patent Document 2: Japanese Laid-Open Patent Publication No. 58-173818

SUMMARY OF THE INVENTION

Problems that the Invention is to Solve

According to the manufacturing method of Patent Document 2, to cancel the swells of the straight part of the coil, the core is provided with the recesses, and the thin conductor is pressed against the core by the pressure roller such that the depressed parts are formed in the thin conductor along the recesses. The shape of the obtained coil follows the outside shape of the core. Hence, according to the manufacturing method of Patent Document 2, the shape of the obtained coil is determined by the shape of the core. However, since the material of the thin conductor slightly differs on a lot-by-lot basis, swell of the coil remains after the coil is pulled out in some cases, or the straight part is recessed because the swelling amount is small on the other hand in some cases. Hence, to manufacture a coil having a desired shape, it is necessary to change the depth of the recess in accordance with a factor of the material of the thin conductor when it is manufactured. Therefore, it is necessary to frequently replace the core.

Accordingly, it is an objective of the present invention to provide an edgewise wound coil manufacturing device capable of manufacturing a coil into a desired shape without frequently exchanging the coil.

Means for Solving the Problems

To achieve the foregoing object and in accordance with one aspect of the present invention, an edgewise wound coil manufacturing device for manufacturing an edgewise wound coil is provided. The edgewise wound coil manufacturing device includes a core, a rotating part, a guide part, a first moving part, and a controller. The core includes a plurality of angle portions and recesses each formed between each pair of the adjacent angle portions. A flat wire is wound around the core. The rotating part rotates the core around a center axis of the core. The guide part guides the flat wire such that the flat wire is wound along the core while sandwiching the flat wire in a thickness direction. The first moving part moves one of the guide part and the core in an approaching/receding direction with respect to the other one of the guide part and the core. The controller adjusts a moving amount of the first moving part such that the edgewise wound coil is formed into a desired shape.

BRIEF DESCRIPTION OF THE DRAWINGS

FIG. 3(*b*) is a schematic diagram showing a state where the guide part is located between the angle portion of the core and a deepest portion of a recess;

FIG. 3(*c*) is a schematic diagram showing a state where the guide part is located on the deepest portion of the recess of the core;

DETAILED DESCRIPTION OF THE PREFERRED EMBODIMENTS

One embodiment according to the present invention will now be described with reference to FIGS. 1 to 5.

Figure 1:
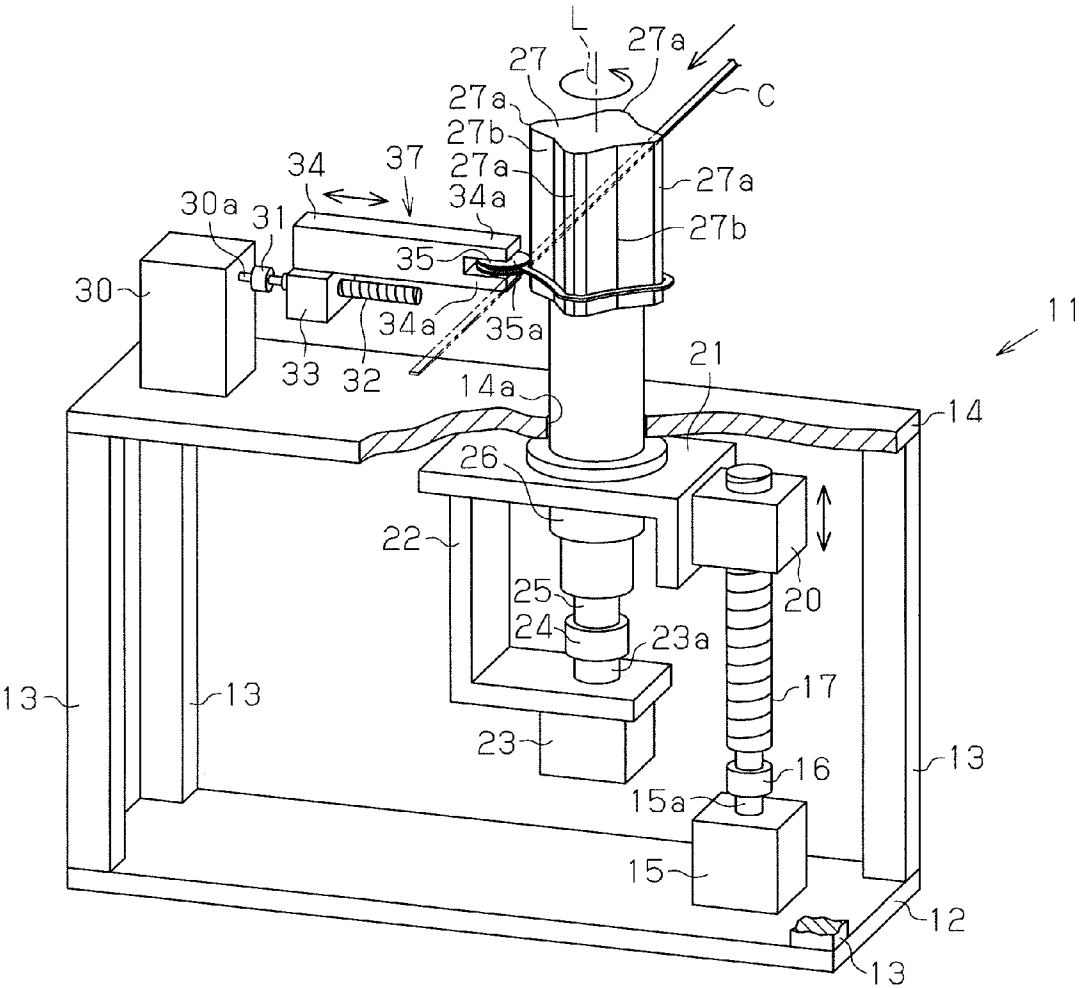
FIG. 1 is a perspective view schematically showing an edgewise wound coil manufacturing device according to one embodiment of the present invention.
Figure 4:
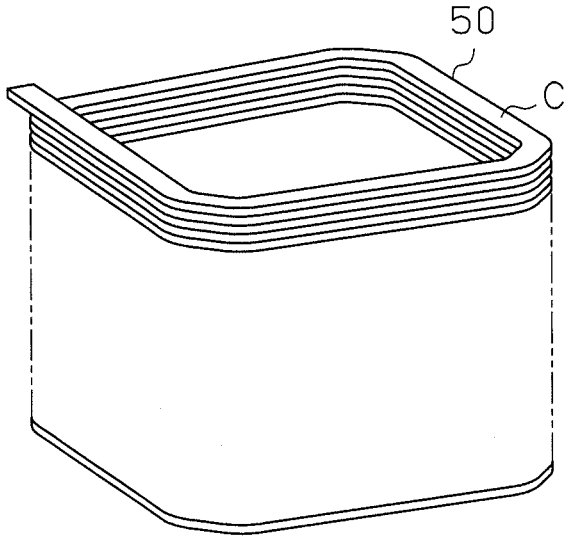
FIG. 4 is a perspective view showing an edgewise wound coil.

As shown in FIG. 1, a flat wire C is a coated copper wire having a rectangular cross section. In the following description, a short side direction of a cross section of the flat wire C intersecting the longitudinal direction thereof is referred to as a thickness direction, and a long side direction of the flat wire C is referred to as a width direction. As shown in FIG. 4, an edgewise wound coil 50 is formed into a square tubular shape by helically winding the flat wire C such that it is superposed in the thickness direction while bending the flat wire C in the width direction.

As shown in FIG. 1, an edgewise wound coil manufacturing device 11 (simply, manufacturing device 11, hereinafter) includes a rectangular plate-shaped base 12, support legs 13 standing on four corners of the base 12, and a support stage 14 supported on these support legs 13. A table-servomotor 15 is provided on the base 12. A table-ball screw 17 is connected to a drive shaft 15*a* of the table-servomotor 15 through a connection member 16. The table-ball screw 17 is driven and rotated by the table-servomotor 15.

The table-ball screw 17 supports a table 21 through a table-converting mechanism 20. The table-converting mechanism 20 converts rotating motion of the table-ball screw 17 into straight motion of the table 21 along the axis of the table-ball screw 17. The table-servomotor 15 can rotate in the forward and reverse directions. The table 21 can be ascended or descended (moved) by controlling rotating directions of the table-servomotor 15.

An L-shaped support arm 22 is connected to a lower surface of the table 21. The support arm 22 extends downward from the lower surface of the table 21 and then extends laterally in parallel to the table 21. A core-servomotor 23 as a rotating part is mounted on a lower portion of the support arm 22. A drive shaft 23*a* of the core-servomotor 23 projects from the core-servomotor 23 toward the table 21. A rotary shaft 25 is connected to the drive shaft 23*a* through a connection member 24. The rotary shaft 25 is driven and rotated by the core-servomotor 23. The rotary shaft 25 is rotationally supported by a bearing 26, which penetrates the table 21. A core 27 is fixed to a distal end of the rotary shaft 25.

Figure 3A:
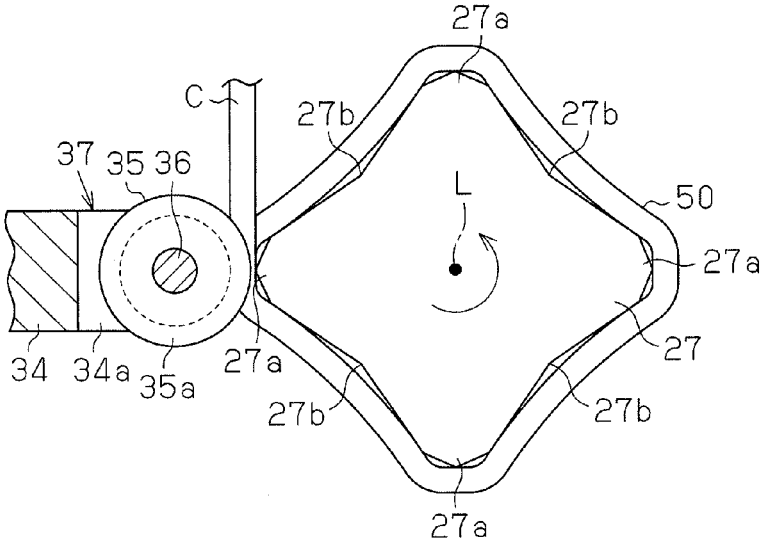
FIG. 3(*a*) is a schematic diagram showing a state where a guide part is located on an angle portion of a core in the edgewise wound coil manufacturing device.
Figure 3B:
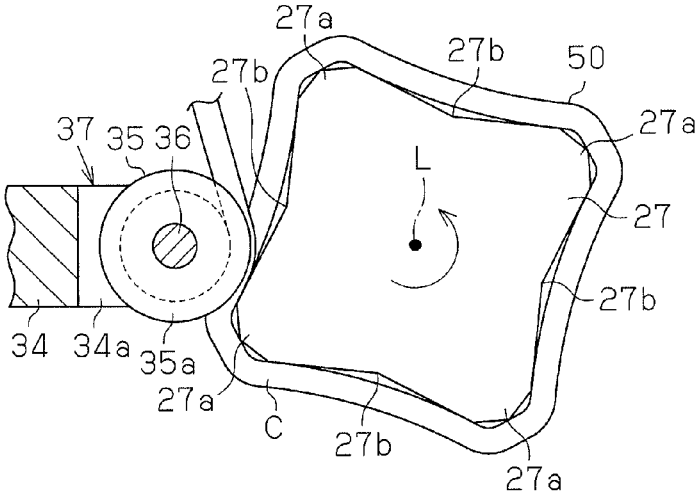
Figure 3C:
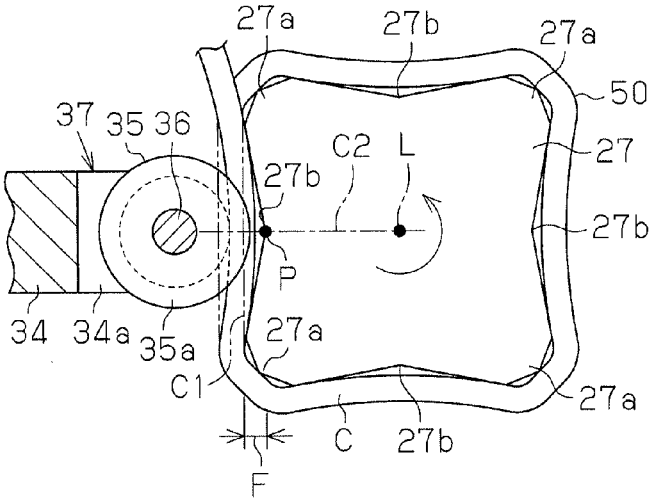

The core 27 will be described. As shown in FIGS. 1 and 3, the core 27 is formed into a substantially square pillar shape. An extending direction of a center axis L of the core 27 is referred to as an axial direction of the core 27. Four angle portions 27*a* of the core 27 are formed into obtuse angles. A recess 27*b* is formed in each of side surfaces of the core 27. Each recess 27*b* is recessed from an adjacent pair of the angle portions 27*a* toward the center axis L of the core 27. Each recess 27*b* has a maximum depth at a position corresponding to an intermediate point between the pair of adjacent angle portions 27*a*. As shown in FIG. 3(*c*), a straight line connecting end edges of the adjacent angle portions 27*a* to each other is defined as an imaginary line C1, and a straight line that intersects the imaginary line C1 at right angles and passes through the center axis L is defined as a straight line C2. A length from the imaginary line C1 to a deepest portion P of the recess 27*b* along the straight line C2 is defined as a depth F of the recess 27*b*.

As shown in FIG. 1, the core 27 is fixed to a distal end of the rotary shaft 25 such that the core 27 rotates around the center axis L. A through hole 14*a* is formed in the support stage 14. The rotary shaft 25 extends the through hole 14*a*. By controlling the rotating directions of the table-servomotor 15, the core 27 can be ascended or descended along the center axis L through the table 21.

A guide part-servomotor 30 is provided on the support stage 14. A drive shaft 30*a* of the guide part-servomotor 30 projects from a side surface of the guide part-servomotor 30 toward the core 27. A guide part-ball screw 32 is connected to the drive shaft 30*a* through a connection member 31. The guide part-ball screw 32 is driven and rotated by the guide part-servomotor 30. The guide part-ball screw 32 supports a support arm 34 through a guide part-converting mechanism 33. The guide part-converting mechanism 33 converts rotating motion of the guide part-ball screw 32 into linear motion of the support arm 34 along the axis of the guide part-ball screw 32. The guide part-servomotor 30 can rotate in the forward and reverse directions. By controlling rotating directions of the guide part-servomotor 30, the support arm 34 can move in directions approaching and separating from the core 27.

Figure 5:
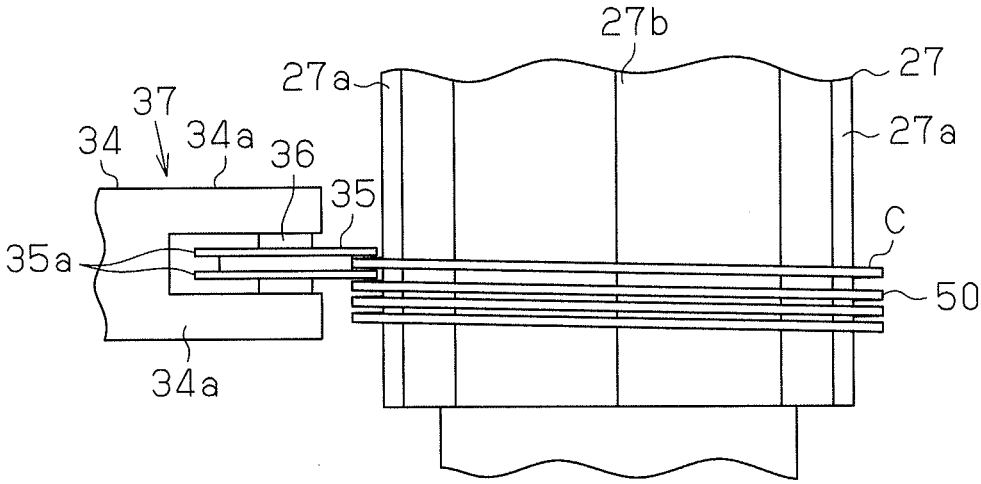
FIG. 5 is a partial diagram showing a state where guide part sandwich a flat wire in its thickness direction in the edgewise wound coil manufacturing device shown in FIG. 1.

As shown in FIG. 5, a pair of support pieces 34*a* is provided on the distal end of the support arm 34 (on the side of core 27) such that the support pieces 34*a* are opposed to each other in the vertical direction at a distance from each other. The guide member 35 is supported by a support shaft 36 between the pair of support pieces 34*a*. The guide member 35 is provided with a pair of disk-shaped guide plates 35*a*, and the guide plates 35*a* guide the flat wire C in a sandwiching manner in the thickness direction. The guide plates 35*a* are opposed to each other at a distance from each other, and this distance is slightly greater than a thickness of the flat wire C. In this embodiment, the support arm 34, the guide member 35 and the support shaft 36 form a guide part 37. By controlling the rotating directions of the guide part-servomotor 30, the guide part 37 (guide member 35) can move in directions in which the guide part 37 (guide member 35) and the core 27 approach and separate from each other (approaching/receding direction, hereinafter). In other words, the guide part 37 (guide member 35) can move relative to the rotating core 27. In the following description, the direction in which the guide part 37 approaches the core 27 is referred to as a deep side, and the direction in which the guide part 37 separates from the core 27 is referred to as an opening side.

Hence, in this embodiment, the guide part-servomotor 30 constitutes a first moving part, which moves the guide part 37 in the approaching/receding direction. As the table 21 is ascended or descended by the table-servomotor 15, the core 27 ascends or descends (moves) with respect to the guide part 37. Hence, the table-servomotor 15 constitutes a second moving part, which ascends or descends (moves) the core 27 along the center axis L.

A bobbin (not shown), around which the flat wire C is wound, and a feeding device (not shown), which feeds the flat wire C from the bobbin to the core 27 of the manufacturing device 11, are located in the vicinity of the manufacturing device 11.

Figure 2:
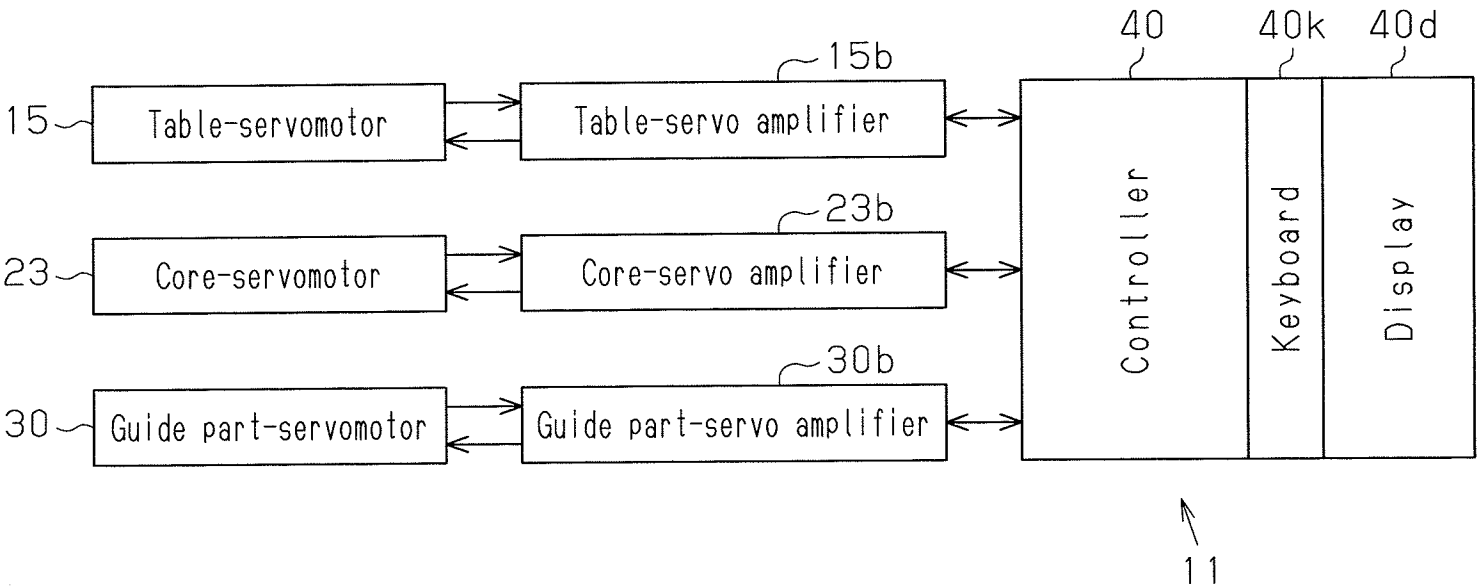
FIG. 2 is a block diagram schematically showing the electrical configuration of the edgewise wound coil manufacturing device shown in FIG. 1.

Next, an electrical configuration of the manufacturing device 11 will be described. As shown in FIG. 2, the manufacturing device 11 includes a controller 40. The controller 40 includes a keyboard 40*k* for inputting various data by operator's operations, and a display 40*d*, on which various information is displayed. Information that is input through the keyboard 40*k* is displayed on the display 40*d*. The table-servomotor 15 is connected to the controller 40 through a table-servo amplifier 15*b*, and the core-servomotor 23 is also connected to the controller 40 through a core-servo amplifier 23*b*. The guide part-servomotor 30 is connected to the controller 40 through a guide part-servo amplifier 30*b*.

Information concerning the flat wire C such as the material thereof and time during which the flat wire C has been wound around the bobbin (not shown) is input to the controller 40 through the keyboard 40*k*. Further, information concerning the core 27 such as the length thereof in the axial direction and the depth F of the recess 27*b* is input to the controller 40 through the keyboard 40*k*. The controller 40 controls the guide part-servo amplifier 30*b* based on the input information concerning the flat wire C and the core 27, thereby controlling the operation of the guide part-servomotor 30. As a result, the moving amount of the guide part 37 (guide member 35) with respect to the core 27 is controlled. By controlling the driving of the guide part-servomotor 30, the guide member 35 can be moved in the approaching/receding direction.

The moving amount of the guide part 37 controlled by the controller 40 is set such that the flat wire C moves within a range smaller than the depth F of the recess 27*b*. In other words, the moving amount of the guide part 37 toward the deep side of the recess 27*b* is set such that an end edge of the flat wire C does not come into contact with the deepest portion P of the recess 27*b* in the side surface of the core 27. The moving amount of the guide part 37 toward the opening side of the recess 27*b* is set such that a linear part of the obtained edgewise wound coil 50 does not swell. Further, the moving amount of the guide part 37 is appropriately adjusted within a range smaller than the depth F of the recess 27*b* in accordance with material and the like of the flat wire C. For example, when a flat wire C made of material that does not spring back almost at all is used, the moving amount of the guide part 37 is set such that the guide part 37 does not press the flat wire C toward the deep side of the recess 27*b* almost at all. When a flat wire C made of material that largely springs back is used, the moving amount of the guide part 37 is set such that the guide part 37 largely presses the flat wire C toward the deep side of the recess 27*b*.

By controlling the core-servo amplifier 23*b* based on information concerning the length of the core 27 in the axial direction, the controller 40 controls time during which the core-servomotor 23 is driven, i.e., time during which the core 27 is rotated. By controlling the table-servo amplifier 15*b* based on information concerning the length of the core 27 in the axial direction, the controller 40 controls time during which the table-servomotor 15 is operated, i.e., time during which the core 27 is ascended or descended.

Next, a manufacturing method of the edgewise wound coil 50 carried out by the manufacturing device 11 will be described.

Information concerning the core 27 such as the length of the core 27 in the axial direction, the depth F of the recess 27*b* and the angle of the angle portion 27*a*, the length between the pair of adjacent angle portions 27*a* is input into the controller 40 beforehand. Information concerning the flat wire C such as material of the flat wire C and winding time of the flat wire C around the bobbin is input into the controller 40 beforehand. Before the manufacturing device 11 is driven, the table 21 is moved upward to a position that is the closest to the support stage 14, and a lower end of the core 27 is located at a position opposed to the guide member 35.

When the manufacturing device 11 is turned ON, the controller 40 drives the core-servomotor 23 such that the core 27 rotates at a predetermined rotation speed through control of the core-servo amplifier 23*b*. The controller 40 drives the table-servomotor 15 such that the core 27 is moved downward at a predetermined lowering speed through control of the table-servo amplifier 15*b*. The controller 40 operates the guide part-servomotor 30 such that the guide member 35 moves in the approaching/receding direction along an outside shape of the core 27 through control of the guide part-servo amplifier 30*b*.

In other words, when the guide member 35 is opposed to the angle portion 27*a* of the core 27 as shown in FIG. 3(*a*), the guide part 37 is moved by the guide part-servomotor 30 such that the flat wire C is bent along the angle portion 27*a*. When the guide member 35 is opposed to the recess 27*b* as shown in FIGS. 3(*b*) and 3(*c*), the guide part 37 is moved by the guide part-servomotor 30 such that the flat wire C extends along the recess 27*b*.

The controller 40 drives the guide part-servomotor 30 such that the guide member 35 moves by a predetermined moving amount with respect to the core 27 through control of the guide part-servo amplifier 30*b*. This moving amount is set such that in the edgewise wound coil 50 obtained by pulling out the core 27, the flat wire C of the linear part does not swell and a swelling amount is small and the linear part is not recessed.

The controller 40 counts time required from the instant when the winding operation of the flat wire C around the core 27 is started to the instant when the winding operation is completed. If the flat wire C is wound around the entire core 27 in the axial direction, the operations of the core-servomotor 23 and the table-servomotor 15 are stopped. Then, the flat wire C is wound around the core 27, the edgewise wound coil 50 is manufactured. When the core 27 is removed, the edgewise wound coil 50 is obtained as shown in FIG. 4.

According to the above described embodiment, the following advantages are obtained.

(1) The edgewise wound coil manufacturing device 11 includes the guide part 37 for guiding the flat wire C such that the flat wire C is wound around the core 27. The guide part 37 can approach and separate from the core 27 by controlling the operation of the guide part-servomotor 30. The moving amount of the guide part 37 with respect to the core 27 can appropriately be varied by controlling driving of the guide part-servomotor 30 by the controller 40. Therefore, when the moving amount of the guide part 37 with respect to the core 27 is adjusted in accordance with a slight difference or the like between materials of the flat wire C, it is possible to prevent the linear part from swelling or being recessed in the edgewise wound coil 50 after the core 27 is removed, and the edgewise wound coil 50 can be manufactured into a desired shape. Hence, to manufacture an edgewise wound coil 50 having a desired shape, it is unnecessary to frequently replace the core 27 in accordance with a factor of material and the like of a flat wire C to be used for manufacturing.

(2) According to the edgewise wound coil manufacturing device 11, the core 27 can be rotationally supported by the table 21, and the table 21 can be ascended or descended (moved) by the table-servomotor 15. Hence, if the core 27 is driven along the center axis L by the table-servomotor 15 while rotating the core 27 by the core-servomotor 23, it is possible to helically wind the flat wire C around the core 27 such that the flat wire C is superposed in the thickness direction, and it is possible to manufacture a square tubular edgewise wound coil 50.

(3) According to the edgewise wound coil manufacturing device 11, the moving amount of the guide part 37 with respect to the core 27 is adjusted so that the flat wire C is bent into a shape conforming to the outside shape of the core 27. The moving amount of the guide part 37 is adjusted within the range smaller than the depth F of the recess 27*b*. The moving amount of the guide part 37 can easily be controlled by driving the guide part-servomotor 30, which is controlled by the controller 40. Therefore, it is possible to manufacture the edgewise wound coil 50 into a desired shape easily without exchanging the core 27.

(4) The guide member 35 of the guide part 37 guides the flat wire C in a state where the flat wire C is sandwiched in the thickness direction. Hence, it is possible to prevent an inner side (on the core 27 side) of the bent portion of the flat wire C from swelling, and to prevent the flat wire C from falling when the edgewise wound coil 50 is manufactured.

(5) The moving amount of the guide part 37 with respect to the core 27 is adjusted in the range smaller than the depth F of the recess 27*b*. Hence, when the flat wire C is pressed toward the deep side of the recess 27*b*, the flat wire C is not pressed against the core 27 over its entire circumference, and the edgewise wound coil 50 can be manufactured not based on the core 27, but based on the guide part 37. In other words, by controlling the moving amount of the guide part 37, it is possible to manufacture the edgewise wound coil 50 into a desired shape without depending upon the shape of the core 27. Hence, it is unnecessary to frequently replace the core 27 in accordance with material and the like of the flat wire C.

(6) According to the edgewise wound coil manufacturing device 11, the core 27 is supported rotationally supported by the table 21, and the table 21 can be ascended or descended (moved) by the table-servomotor 15. When the edgewise wound coil 50 is manufactured, the guide part 37, which is not ascended or descended (moved), winds the flat wire C around the core 27, which is descended (moved) along the center axis L. Therefore, the flat wire C, which is guided by the guide part 37 is not moved up or down (varied) by the ascending or descending of the guide part 37 unlike the case where the ascending or descending guide part 37 winds the flat wire C around the core 27, which does not ascend or descend. Hence, if a method of ascending or descending the core 27 along the center axis L is employed instead of vertically moving the guide part 37, gaps between superposed flat wires C are not varied, and it is possible to accurately wind the flat wire C around the core 27.

(7) The moving amount of the guide part 37 with respect to the core 27 is adjusted in accordance with the slight difference and the like of materials of the flat wire C. According to this adjustment, it is possible to prevent the linear part from swelling or from being recessed in the edgewise wound coil 50 after the core 27 is removed, and it is possible to manufacture the edgewise wound coil 50 into a desired shape. Therefore, it is possible to omit labor for straightening a swelled part of the obtained edgewise wound coil 50.

(8) According to the edgewise wound coil manufacturing device 11, the guide part 37 sandwiches the flat wire C, presses the flat wire C against the core 27 and in this state, the flat wire C is wound around the core 27, and the edgewise wound coil 50 can be manufactured. In other words, since the guide part 37 (guide member 35) sandwiches the flat wire C, it is possible to prevent the flat wire C from falling or twisting in the thickness direction when the flat wire C is bent, and the guide part 37 can guide the flat wire C such that flat wire C is helically wound around the core 27 in its axial direction. Further, since the flat wire C is bent along the four angle portions 27*a*, and wound and superposed in the axial direction of the core 27, it is possible to adjust the moving amount of the guide part 37 with respect to the core 27. In other words, according to the edgewise wound coil manufacturing device 11, the flat wire C can be bent in a state where it is reeled up around the core 27. Hence, the edgewise wound coil manufacturing device 11 does not have a problem that a manufacturing flow is interrupted due to a feeding operation of the flat wire C in contrast to a bender-type device in which a coil is manufactured by repetition of a feeding operation and a bending operation of the flat wire C. Hence, it is possible to shorten the manufacturing time as compared with a case where the edgewise wound coil 50 is manufactured by the bender-type device.

(9) According to the edgewise wound coil manufacturing device 11, it is possible to bend flat wire C in a state where the flat wire C is reeled up around the core 27. Therefore, since the feeding operation of the flat wire C as in the bender-type device is not included, vibration of flat wire C generated when the flat wire C is sent is eliminated, and it is possible to avoid a case where the flat wire C receives vibration and the flat wire C becomes large in the thickness direction, and a case where gaps between the superposed flat wires C are varied.

(10) By adjusting the moving amount of the guide part 37 with respect to the core 27, the flat wire C is formed along the outside shape of the core 27 in a manner that the flat wire C is not pressed against the core 27 over its entire circumference. Hence, it is unnecessary to increase the rigidity of the guide member 35 and the core 27 as compared with a case where the flat wire C formed in a manner that it is pressed against the core 27 over its entire circumference.

(11) The moving amount of the guide part 37 with respect to the core 27 can be adjusted by controlling the operation of the guide part-servomotor 30 by the controller 40. Hence, by adjusting the moving amount, it is possible to bend the flat wire C in accordance with the angles of the angle portions 27*a* of the core 27. Therefore, it is possible to bend the flat wire C irrespective of a shape of the core 27, and to easily manufacture a polygonal edgewise wound coil 50.

(12) The core 27 includes the four angle portions 27*a* and recesses 27*b* between the pair of adjacent angle portions 27*a*. In other words, each of the side surfaces of the core 27 is recessed inward of the core 27. A portion of the flat wire C that is opposed to the recess 27*b* is pressed toward the recess 27*b*. Therefore, even if the spring back of the flat wire C is generated after the core 27 is removed, deformation caused by the spring back is canceled by the deformation of the flat wire C caused by being pressed against the recess 27*b*, the linear part of the edgewise wound coil 50 can be formed into a straight line, and a square tubular shape can be maintained.

The above described embodiment may be modified as follows.

In the above embodiment, the table 21 is ascended or descended (moved) by the table-servomotor 15, the core 27, which is rotationally supported by the table 21, is ascended or descended (moved), thereby ascending or descending (moving) the core 27 with respect to the guide part 37 (guide member 35). Instead of this configuration, the core 27 may only be rotated without ascending or descending (moving) the core 27, and the guide part 37 (guide member 35) may be ascended or descended (moved) with respect to the core 27. In this case, the second moving part ascends or descends (moves) the guide part 37.

Figure 6:
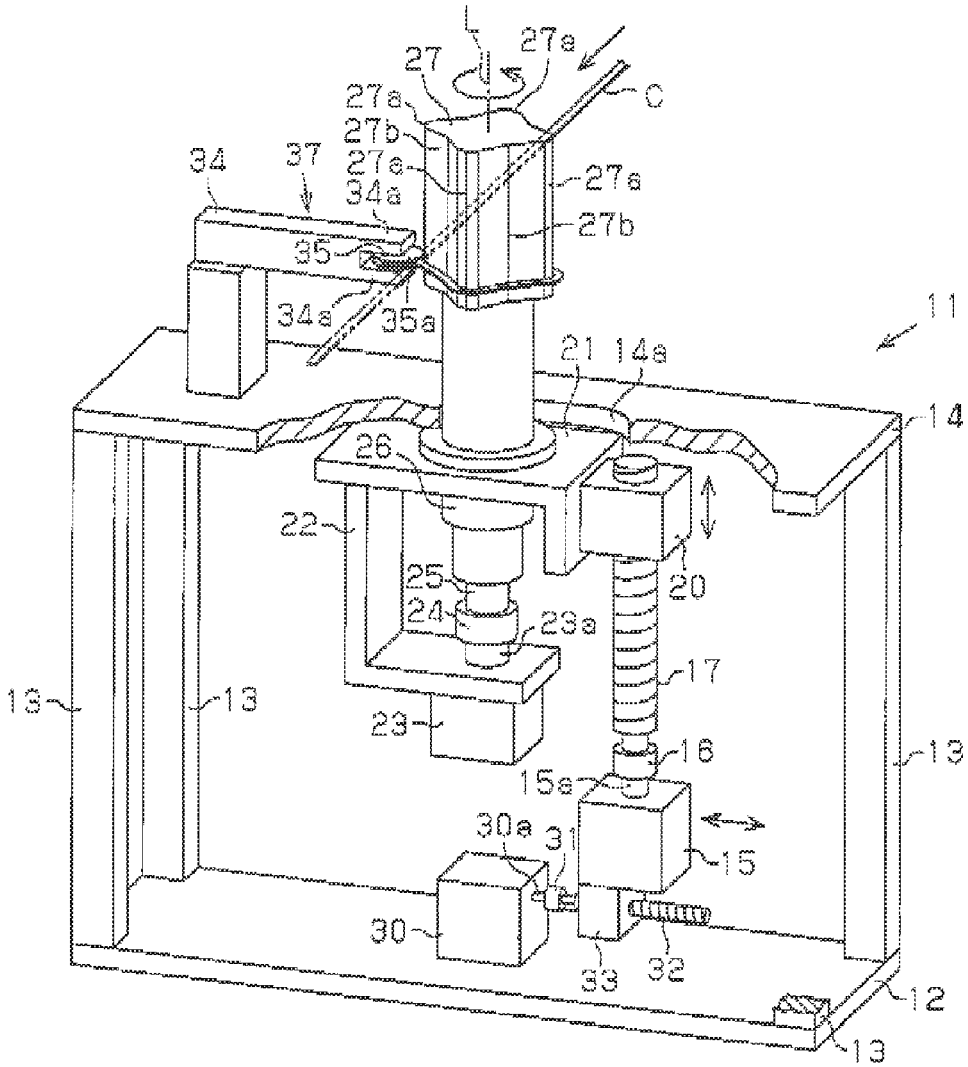
FIG. 6 is a perspective view schematically showing an edgewise wound coil manufacturing device according to an embodiment of the present invention.

In the above embodiment, the guide part 37 (guide member 35) is moved in the approaching/receding direction with respect to the core 27. Instead of this configuration, the core 27 may be moved in the approaching/receding direction with respect to the guide part 37 (guide member 35) without moving the guide part 37 (guide member 35). In this case, for example as shown in FIG. 6, the first moving part moves the core 27 in the approaching/receding direction.

In the above embodiment, the guide part 37 (guide member 35) moves in the approaching/receding direction with respect to the core 27. Instead of this configuration, the core 27 and the guide part 37 (guide member 35) may move in the approaching/receding direction with respect to each other. In this case, the first moving part moves both the core 27 and the guide part 37.

In the above embodiment, the first moving part of the guide part 37 (guide member 35) is embodied as the guide part-servomotor 30. Instead of this, it is possible to use a cam member that abuts against the base end surface of the support arm 34 in a state where the guide member 35 is supported by the distal end of the support arm 34 of the guide part 37, and is rotationally supported by the table 21. The guide member 35 may be moved in the approaching/receding direction through the support arm 34 by periodically abutting the cam member against the base end surface of the support arm 34 with rotation of the cam member.

Although the core 27 is of the square pillar shape in the above embodiment, the number of the angles may freely be changed as long as the core 27 is of the polygonal pillar shape. The core 27 may be of the polygonal tubular shape instead of the polygonal pillar shape.

Although the core 27 is of the square pillar shape in the above embodiment, the core 27 does not need to be of the pillar shape. For example, it is possible to use a core formed by rod-like members located at positions where the angle portions of an edgewise wound coil 50 to be manufactured are formed, and recesses formed between adjacent rod-like members.

Although the edgewise wound coil is of the square tubular shape formed by helically winding the flat wire C such that the flat wire C is superposed in the thickness direction in the above embodiment, the present invention can also be applied to an edgewise wound coil in which the flat wire C is only wound less than one turn. In this case, the second moving part, which moves one of the core 27 and the guide part 37 along the center axis L of the core 27, is unnecessary.

The invention claimed is:

1. An edgewise wound coil manufacturing device for manufacturing an edgewise wound coil, the device comprising:

a core including a plurality of angle portions and recesses each formed between each pair of the adjacent angle portions, wherein a flat wire is wound about the core;

a rotating part configured to rotate the core around a center axis of the core;

a guide part configured to guide the flat wire such that the flat wire is pressed toward a deep side of the recess of the core and wound along the core while sandwiching the flat wire in a thickness direction;

a first moving part configured to move one of the guide part and the core in an approaching/receding direction with respect to the other one of the guide part and the core; and a controller configured to adjust a moving amount of the first moving part such that the edgewise wound coil is formed into a desired shape, wherein the controller adjusts the moving amount of the first moving part such that the flat wire moves within a range smaller than a depth of the recess.

2. The edgewise wound coil manufacturing device according to claim 1, wherein the edgewise wound coil is formed into a polygonal tubular shape by helically winding the flat wire such that the flat wire is superposed in the thickness direction, and the edgewise wound coil manufacturing device further includes a second moving part that moves the core along the center axis of the core.

3. The edgewise wound coil manufacturing device according to claim 1, wherein the first moving part includes a servomotor for moving the guide part in directions approaching and separating from the core.

4. The edgewise wound coil manufacturing device according to claim 1, wherein the guide part includes a guide member for sandwiching the flat wire, and a support arm for supporting the guide member through a support shaft.

5. The edgewise wound coil manufacturing device according to claim 1, wherein the approaching/receding direction is perpendicular to a rotational axis of the core.

* * * * *